US005754987A

United States Patent [19]

Johansson et al.

[11] Patent Number: 5,754,987

[45] Date of Patent: May 26, 1998

[54] VACUUM UNIT AND A VACUUM TOILET SYSTEM COMPRISING SUCH A UNIT

[75] Inventors: Håkan Johansson, Stockholm; Karl-Erik Johansson, Mullsjö, both of Sweden

[73] Assignee: AVAC Ejektor AB, Mullsjo, Sweden

[21] Appl. No.: 765,093

[22] PCT Filed: Jun. 7, 1995

[86] PCT No.: PCT/SE95/00674

§ 371 Date: Jan. 6, 1997

§ 102(e) Date: Jan. 6, 1997

[87] PCT Pub. No.: WO96/01345

PCT Pub. Date: Jan. 18, 1996

[30] Foreign Application Priority Data

Jul. 6, 1994 [SE] Sweden ..... 9402392

[51] Int. Cl.[6] ..... E03D 11/00

[52] U.S. Cl. ..... 4/431; 4/321; 417/160

[58] Field of Search ..... 4/321, 323, 431, 4/434; 417/160

[56] References Cited

U.S. PATENT DOCUMENTS

| | | | |
|---|---|---|---|
| 1,121,297 | 12/1914 | Schmitt | 417/160 |
| 1,678,258 | 7/1928 | MacDonald | 417/160 |
| 3,730,884 | 5/1973 | Burns et al. | 4/321 X |
| 4,865,631 | 9/1989 | Stroby et al. | 4/378 X |
| 5,133,853 | 7/1992 | Mattsson et al. | 4/431 X |
| 5,214,807 | 6/1993 | Terve | 4/321 |

FOREIGN PATENT DOCUMENTS 468485 1/1993 Sweden .

*Primary Examiner*—Robert M. Fetsuga
*Attorney, Agent, or Firm*—Sughrue, Mion, Zinn, Macpeak & Seas, PLLC

[57] ABSTRACT

A vacuum unit, intended particularly for a vacuum toilet system, includes two valves (4, 6) which can be connected to a compressed-air source, an ejector (10) which includes an inlet nozzle (10*a*), an outlet nozzle (10*b*) and a vacuum opening (10*c*). The ejector is connected to the first valve (4) via the inlet nozzle, and to a first vacuum-unit connection (U1), via the vacuum opening. A piston valve (16) includes a first inlet (16*a*), a second inlet (16*b*) and an outlet (16*c*). The first inlet connects the piston valve with the ejector outlet nozzle (10), the second inlet connects the piston valve with the second valve (6), and the outlet connects the piston valve with a second vacuum-unit connection (U2). A check valve (17) is mounted between the piston valve outlet (16*c*) and the second vacuum-unit connection (U2). A passageway connects the second valve (6) and the second inlet (16*b*) of the piston valve with a further ejector inlet (10*d*). The further ejector inlet (10*d*) is directed generally at right angles to the ejector inlet nozzle (10*a*) and the rejector outlet nozzle (10*b*). The valves (4, 6) can be connected to one and the same source of compressed air via a common inlet.

8 Claims, 2 Drawing Sheets

VACUUM UNIT AND A VACUUM TOILET SYSTEM COMPRISING SUCH A UNIT

TECHNICAL FIELD

The present invention relates to a unit for generating, maintaining and eliminating a vacuum in, for instance, a tank intended for collecting and further transporting waste in a vacuum toilet. The invention also relates to a system which includes a vacuum unit constructed in accordance with the invention.

BACKGROUND

Vacuum ejectors which work in accordance with the so-called venturi principle are known to the art and are used to generate a subpresssure, e.g., in a tank connected thereto. Such ejectors are able typically to generate a vacuum of up to 90%.

When an ejector of such a vacuum unit is coupled to a system which includes a tank and compressed-air conduits for the purpose of generating both pressure conditions and vacuum conditions, fitting and coupling of the system elements normally requires a large quantity of auxiliary material. A conventional ejector cannot be used in couplings such as these without providing a relatively large number of auxiliary devices, particularly in vacuum toilet systems.

In order to maintain the vacuum generated in the unit connected to the tank, the known vacuum units include a check valve between the ejector and the tank, so as to prevent the inflow of air from the system to the tank, via the ejector.

This check valve, however, presents a problem. Firstly, it makes it difficult to integrate all desired functions in the vacuum unit itself, since compressed air must then be delivered through a separate channel when the tank is to be emptied, and secondly, it is not possible to provide a self-cleaning unit because the check valve prevents air from flowing to the tank from the ejector.

The earlier known systems are also bulky and heavy.

OBJECT OF THE INVENTION

The object of the present invention is therefore to eliminate the aforesaid problems, by providing a vacuum unit of the kind defined in the introduction in which all operationally necessary functions are integrated and which is self-cleaning and lighter in weight than known vacuum units and which can be installed more easily than said known units.

Another object of the present invention is to provide a vacuum toilet system which includes one such vacuum unit.

SUMMARY OF THE INVENTION

Fundamentally, the invention is based on the insight that these objects can be achieved with a vacuum unit in which the check valve is instead mounted in a unit-mounted ventilation connection.

Thus, there is provided in accordance with the invention a vacuum unit which includes a first valve that can be connected to a compressed-air source, a second valve that can be connected to a compressed-air source, an ejector that includes an inlet nozzle, an outlet nozzle and a vacuum opening, wherein the ejector is connected to the first valve via the inlet nozzle and to a first vacuum-mounted connection via the vacuum opening, and further comprises a piston valve having a first inlet, a second inlet and an outlet, wherein the piston valve is connected to the ejector outlet nozzle via the first inlet and to the second valve via the second inlet and to a second vacuum unit mounted connection via the outlet, and further comprises a check valve mounted between the piston-valve outlet and the vacuum unit mounted connection, and a passageway which connects the second valve and the second input of the piston valve to an ejector inlet.

With this arrangement, it is possible to provide a compact, integrated vacuum unit which includes an ejector placed in the centre of the unit, and also a unit which is self-cleaning. The ejector input is preferably directed generally at right angles to the ejector inlet nozzle and outlet nozzle.

It is preferred that the valves can be connected to one and the same compressed-air source, through a common inlet.

In accordance with a preferred embodiment of the vacuum unit, the unit includes a pressure sensor and a safety valve which are connected to the first unit-mounted connection.

A unit of this construction can be manufactured advantageously by injection-moulding with acetal resin.

In accordance with one preferred embodiment, a filter is included integrally with the first unit-mounted connection to prevent the ingress of harmful particles.

The invention also relates to a vacuum toilet system which includes a vacuum unit of this kind.

BRIEF DESCRIPTION OF THE DRAWINGS

The invention will now be described in more detail with reference to an exemplifying embodiment thereof and also with reference to the accompanying drawings, in which.

DETAILED DESCRIPTION OF THE INVENTION

A preferred embodiment of an inventive vacuum unit and a toilet system that includes one such unit will now be described.

Figure 1:
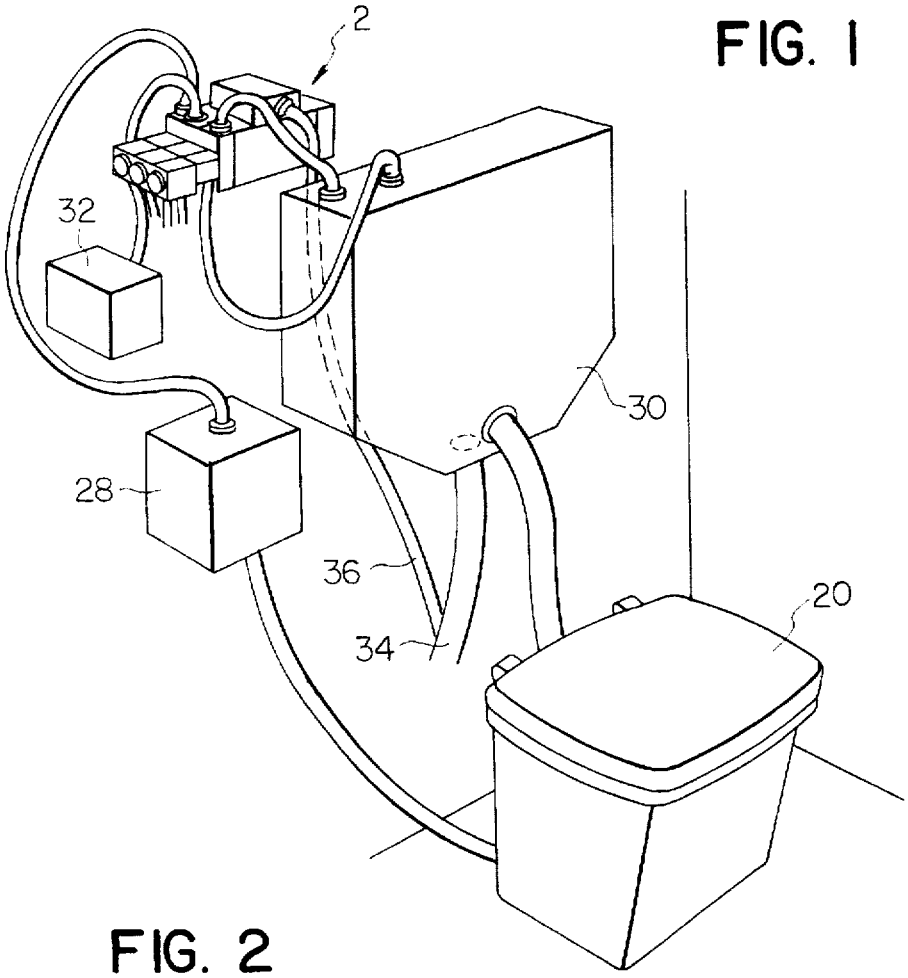
FIG. 1 is a perspective view of an inventive vacuum unit.
Figure 2:
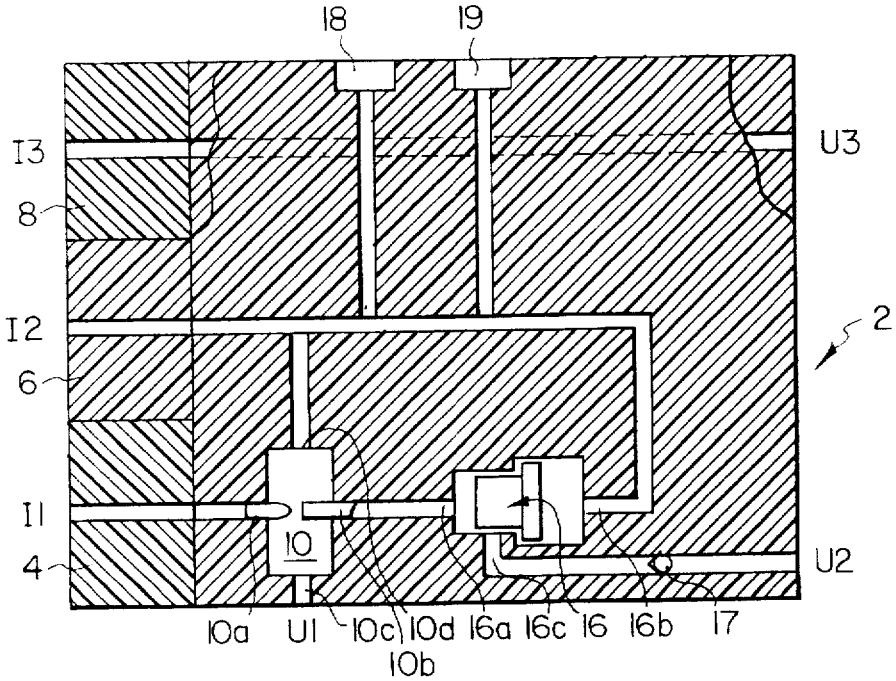
FIG. 2 is a diagram which shows the fundamental principles of the vacuum unit shown in FIG. 1.

The unit 2, which is shown in FIG. 1 and the fundamental principles of which are shown diagrammatically in FIG. 2, includes three solenoid valves 4, 6 and 8, each of which can be connected to a compressed-air source through a respective inlet I1, I2, I3. Although the illustrated vacuum unit includes three compressed-air inlets, it will be understood that the three solenoid valves 4, 6, 8 may alternatively be connected to a single common compressed-air inlet on the vacuum unit.

The first solenoid valve 4 controls the supply of compressed air to the inlet nozzle 10*a* of an ejector 10. The main purpose of the solenoid valve 6 is to inject compressed air through a connection U1 and to operate a piston valve 16. The third solenoid valve 8 controls additional functions externally of the unit.

Figure 3:
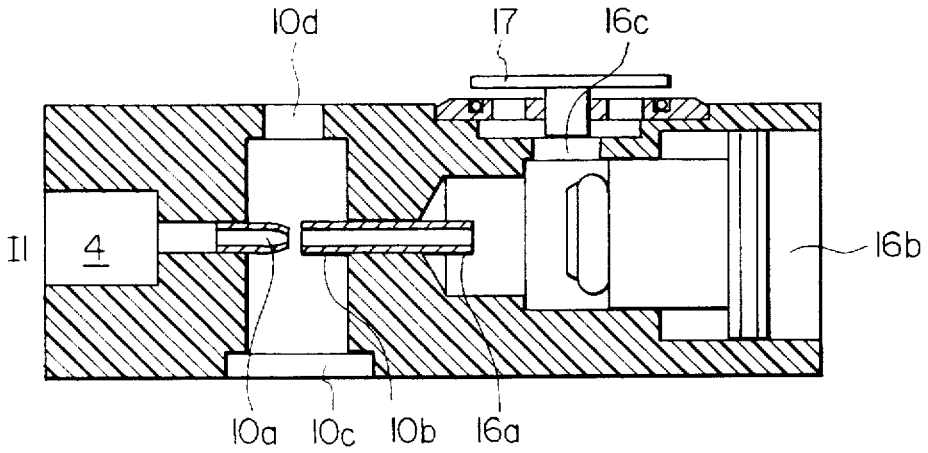
FIG. 3 is a cross-sectional view of the vacuum unit shown in FIG. 1.

The ejector 10 is shown in more detail in FIG. 3. The ejector 10 functions to generate a vacuum in a space in the ejector as air flows from the inlet nozzle 10*a* to an outlet nozzle 10*b*, and also to generate a vacuum in units that are connected to said space via a vacuum opening 10*c*.

As will be seen from FIG. 2, the ejector inlet nozzle 10*a* is connected to the first solenoid valve 4, and the vacuum opening 10*c* is connected to a first vacuum unit mounted connection U1. A filter means is also preferably mounted in or adjacent the first connection U1.

The ejector outlet nozzle 10*b* is connected to a first inlet 16*a* of a piston valve 16. The piston valve includes an outlet 16*c* which is connected to a second vacuum unit mounted connection U2, via a check valve 17 which allows air to flow from the piston-valve outlet 16*c*. A ventilation conduit may be connected to the connection U2 so as to obtain a fully closed system.

The piston valve 16 is connected to the second solenoid valve 6, via a second inlet 16*b*. Distinct from known vacuum units, this second inlet is also connected to a further ejector inlet 10*d* which is generally at right angles to the ejector inlet nozzle 10*a* and the outlet nozzle 10*b*.

The vacuum unit 2 also includes a third solenoid valve 8, which is used to place other system components under pressure, via a third connection U3 on the vacuum unit. This third solenoid valve 8 is integrated in the unit 2, to provide a simpler and more compact construction.

The vacuum unit 2 also includes a pressure sensor 18, which is connected to the connection U1. When vacuum conditions exist in a tank that is connected to the vacuum unit via the connection U1, the sensor will send a signal to a control unit (not shown).

The unit includes a safety valve 19, which is also connected to the connection U1.

The inventive unit 2 is preferably injection-moulded from acetal resin (POM).

The manner in which the inventive vacuum unit works will now be described with reference to a typical working cycle of an inventive unit used in a vacuum toilet system.

Figure 4:
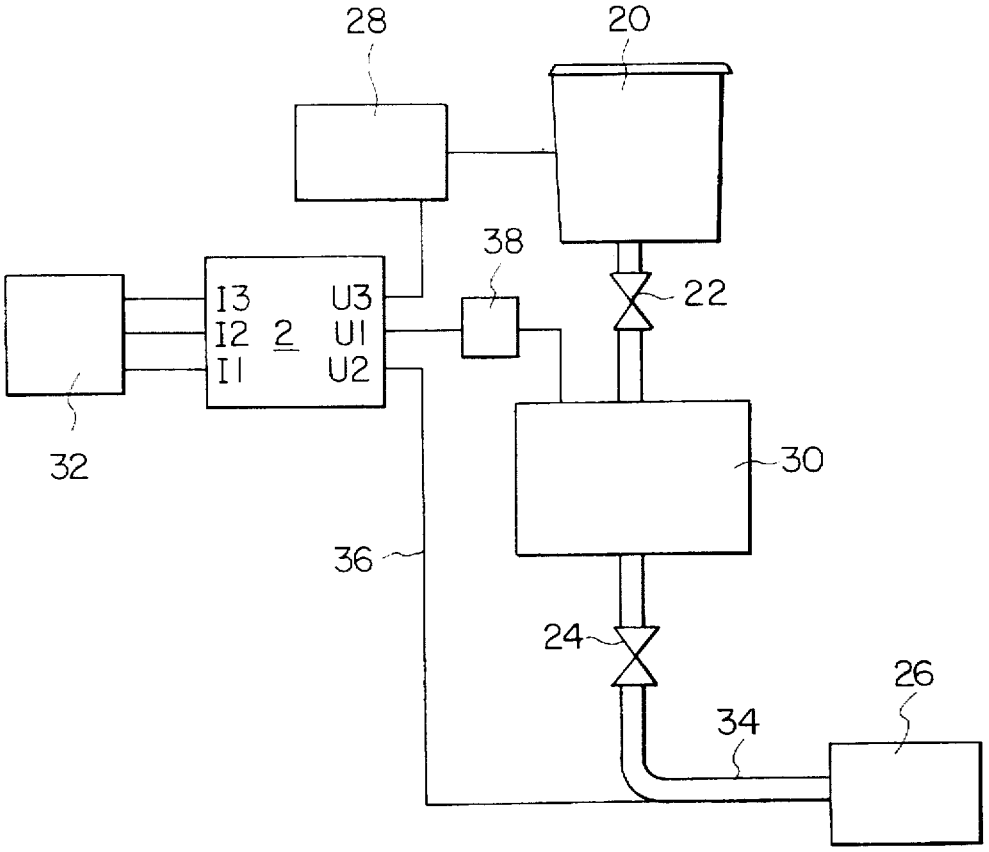
FIG. 4 illustrates the fundamental principles of a toilet system that includes an inventive vacuum unit.

This system is illustrated in FIG. 4 and includes a toilet or lavatory 20, which may be a conventional vacuum toilet and which is connected via an inlet valve 22 to a pressure-safe tank 30 for the intermediate storage of material delivered to the tank from the toilet 20. In the case of the preferred embodiment, the tank has a volumetric capacity of about 5 liters, although in normal operation it is not filled to more than about 2 dl.

The system also includes a waste collecting vessel 26, which is connected to the tank 30 via an outlet valve 24 and an outlet pipe 34. The valves 22, 24 are operated by means of valve setting devices controlled by the control unit. A water container 28 is connected to the toilet 20.

The system also includes an inventive vacuum unit 2 which is operated with compressed air taken from a compressed-air source 32. The first connection U1 of the vacuum unit is connected to the pressure tank 30 via a filter 38, the second connection U2 of the vacuum unit connects to the outlet conduit 34 via a ventilating conduit 36, and the third connection U3 of the vacuum unit is connected to the water container 28.

No vacuum exists initially in the tank 30. When the first solenoid valve 4 is activated, for instance by means of an electric pulse, e.g. a 24 V d.c. pulse, from an electric power source (not shown), compressed air is able to pass through the valve from the compressed air source 32. This air flows straight through the ejector 10, from the smaller inlet nozzle 10*a* to the larger outlet nozzle 10*b*, therewith generating a vacuum or subpressure in the ejector 10 and also in the tank 30. The filter 38 present between the unit 2 and the tank 30 prevents large particles being drawn from the tank and into the ejector 10 from the tank by suction.

The air leaving the ejector 10 through the outlet nozzle continues to the piston valve 16 and flows from the piston valve via the check valve 17, and thereafter out through the second connection U2 of the vacuum unit 2. The air continues to pass through the ventilating conduit 36 and through the outlet conduit 34, where it has a cleaning function. The check valve 17 seated between the outlet 16*c* of the piston valve 16 and the vacuum-unit connection U2 permits air to flow in this direction.

The valves 22 and 24 are closed in this stage of the working cycle.

A signal is delivered from the pressure sensor to the vacuum unit 2 when a vacuum has been generated in the tank 30. In this state of the process, the solenoid valve 4 closes and the toilet is ready for use. At this stage, the check valve 17 prevents air flowing into the tank 30 from the ventilating conduit 36, via the piston valve 16 and the ejector 10. Should air flow into the tank 30 for some reason or other, so that the vacuum no longer exists, the process returns to the initial stage in which the first solenoid valve 4 is activated.

The vacuum toilet can be prepared in this way to await a toilet flushing signal, or the creation of a vacuum can be commenced in response to a flushing signal. This flushing signal can be produced with the aid of a press button, or in some other way, for instance by means of a switch connected to the toilet lid. When this flushing signal is received and a vacuum exists in the tank 30, the inlet valve 22 opens and the vacuum existing in the tank 30 causes the toilet contents to be sucked into the tank together with water from the water container 28, which in this stage of operations is pressurized via the third solenoid valve 8.

When the contents of the toilet have been sucked into the tank 30, the inlet valve 22 closes and the outlet valve 24 opens. In this stage, the second solenoid valve 6 opens and forces compressed air into the ejector at right angles to the nozzles, at the same time as the piston of the piston valve 16 is displaced, by virtue of the piston having a greater surface area towards the inlet 16*b* than towards the inlet 16*a*. The piston therewith blocks the passage of air through the second connection U2 of the vacuum unit, with the exception of a negligible time period immediately after activation of the second solenoid valve 6. All air will then flow through the ejector and into the tank, via the filter 38. The ejector 10 and the filter 38 are also cleaned of undesirable particles in this way, at the same time as the tank 30 is emptied into the collecting container 26.

The second solenoid valve 6 and the outlet valve 24 are then closed, preferably in a time-controlled manner, and the procedure can be repeated.

Although the inventive vacuum unit has been described above with reference to a preferred embodiment thereof, it will be understood that the illustrated embodiment can be modified in several respects within the scope of the following claims. For instance, the filter 38 can be integrated in the vacuum unit, to provide a more compact construction.

Furthermore, although the ejector of the preferred embodiment includes one inlet nozzle and one outlet nozzle, it will be understood that the injector may alternatively include several inlet and outlet nozzles.

We claim:

1. A vacuum unit for a toilet system, said vacuum unit comprising:

a) a first valve (4) connected to a source of compressed air;

b) a second valve (6) connected to a source of compressed air;

c) an ejector (10) having an inlet nozzle (10*a*), an outlet nozzle (10*b*) and a vacuum opening (10*c*), wherein the ejector is connected to the first valve via the inlet nozzle, and to a first vacuum-unit connection (U1) via the vacuum opening;

d) a piston valve (16) having a first inlet (16*a*), a second inlet (16*b*) and an outlet (16*c*), wherein the first inlet connects the piston valve to the ejector outlet nozzle, the second inlet connects the piston valve to the second valve, and the outlet connects the piston valve to a second vacuum-unit connection (U2);

e) a check valve (17) mounted between the piston valve outlet and the second vacuum-unit connection; and f) a passageway connecting the second valve and the second piston valve inlet with a further ejector inlet (10*d*).

2. A vacuum unit according to claim 1, wherein the further ejector inlet (10*d*) is directed generally at right angles to the ejector inlet nozzle (10*a*) and the ejector outlet nozzle (10*b*).

3. A vacuum unit according claim 1, further comprising a filter mounted between the ejector vacuum opening (10*c*) and the first vacuum-unit connection (U1).

4. A vacuum unit according to claim 1, wherein the valves are connected to a same compressed-air source, via a common inlet.

5. A vacuum unit according to claim 1, further comprising a pressure sensor (18) connected to the first vacuum-unit connection (U1).

6. A vacuum unit according to claim 1, further comprising a safety valve (19) connected to the first vacuum-unit connection (U1) of the vacuum unit (2).

7. A vacuum unit according to claim 1, wherein the unit is manufactured by injection-moulding.

8. A vacuum unit according to claim 7, wherein the unit is made of acetal resin.

* * * * *